United States Patent [19]

Chen

[11] Patent Number: 4,720,444

[45] Date of Patent: Jan. 19, 1988

[54] LAYERED AMORPHOUS SILICON ALLOY PHOTOCONDUCTIVE ELECTROSTATOGRAPHIC IMAGING MEMBERS WITH P, N MULTIJUNCTIONS

[75] Inventor: Inan Chen, Webster, N.Y.

[73] Assignee: Xerox Corporation, Stamford, Conn.

[21] Appl. No.: 891,017

[22] Filed: Jul. 31, 1986

[51] Int. Cl.[4] ..... G03G 5/14; G03G 5/082

[52] U.S. Cl. ..... 430/58; 430/86; 430/85; 357/88

[58] Field of Search ..... 430/57, 85, 86, 58

[56] References Cited

U.S. PATENT DOCUMENTS 4,357,179 11/1982 Adams et al. ..... 148/1.5

4,561,005 12/1985 Shannon ..... 357/88 X

*Primary Examiner*—J. David Welsh

*Attorney, Agent, or Firm*—E. O. Palazzo

[57] ABSTRACT

An imaging member comprised of a supporting substrate, a p,n multijunction photogenerating layer comprised of from about 8 to about 100 alternating layers of components selected from the group consisting of hydrogenated amorphous silicon, hydrogenated amorphous germanium, and alloys of hydrogenated amorphous silicon and hydrogenated amorphous germanium; and a charge transporting layer.

43 Claims, 2 Drawing Figures

LAYERED AMORPHOUS SILICON ALLOY PHOTOCONDUCTIVE ELECTROSTATOGRAPHIC IMAGING MEMBERS WITH P, N MULTIJUNCTIONS

BACKGROUND OF THE INVENTION

This invention is generally directed to layered hydrogenated amorphous silicon alloy imaging members; and more specifically, the present invention is directed to layered photoconductive imaging members comprised of a number of layers of, for example, hydrogenated amorphous silicon, hydrogenated amorphous germanium, or alloys thereof, and certain charge transport layers. Therefore, in one embodiment of the present invention, there is provided a layered photoresponsive imaging member comprised of a supporting substrate; a charge transport layer comprised of various components inclusive of, plasma deposited hydrogenated amorphous silicon, silicon oxides, silicon nitrides, silicon carbides, boron nitrides, amorphous carbon, and organosilanes; and a photogenerating layer comprised of number of thin alternating p, n components, inclusive of hydrogenated n-type amorphous silicon alloys doped with phosphorus and hydrogenated p-type amorphous silicon alloys, doped with boron. Further, in an alternative specific embodiment of the present invention there is provided a layered photoresponsive imaging member wherein the alternating p, n thin layers are comprised of infrared sensitive materials such as hydrogenated amorphous germanium. Moreover, the imaging members of the present invention can be comprised of a supporting substrate, a charge transport layer of hydrogenated amorphous silicon, and a phtotgenerating layer comprised of a number of thin alternating p, n components, inclusive of hydrogenated n-type amorphous silicon alloys, or hydrogenated p-type amorphous silicon alloys. These imaging members can be incorporated into electrophotographic, and in particular, xerographic imaging and printing systems wherein, for example, the latent electrostatic patterns which are formed can be developed into images of high quality and excellent resolution. Additionally, the members of the present invention possess high charge acceptance values in excess of 1,000 volts for example; excellent low dark decay characteristics; superior charging ability without an increase in dark decay; and further, these members can be of a very desirable thickness from, for example, about 10 microns or less. Furthermore, the photoresponsive imaging members of the present invention when incorporated into xerographic imaging and printing systems are insensitive to humidity and corona ions generated permitting the formation of acceptable images of high resolution for an extended number of imaging cycles.

Electrostatographic imaging, particularly xerographic imaging processes, are well known, and are extensively described in the prior art. In these processes, a photoresponsive or photoconductor material is selected for the formation of the latent electrostatic image thereon. The conductor is generally comprised of a conductive substrate containing on its surface a layer of photoconductive material; and in many instances, a thin barrier layer is situated therebetween to prevent charge injection from the substrate, which could adversely affect the quality of the resulting image. Examples of known useful photoconductive materials include amorphous selenium, alloys of selenium such as selenium-tellrium, selenium-arsenic, and the like. Additionally, there can be selected as the photoresponsive imaging member various organic photoconductive materials including, for example, complexes of trinitrofluorenone and polyvinylcarbazole. Recently there has been disclosed layered organic photoresponsive devices with aryl amine hole transporting molecules, and photogenerating layers, reference U.S. Pat. No. 4,265,990, the disclosure of which is totally incorporated herein by reference.

Also known are amorphous silicon photoconductors, reference for example U.S. Pat. Nos. 4,265,991 and 4,225,222. There is disclosed in the '991 patent an electrophotographic photosenstive member comprised of a substrate, and a photoconductive overlayer of amorphous silicon containing 10 to 40 atomic percent of hydrogen and having a thickness of 5 to 80 microns. Additionally, this patent describes several processes for preparing amorphous silicon. In one process embodiment, there is prepared an electrophotographic photosensitive member by heating the member present in a chamber to a temperature of 50 degrees Centigrade to 350 degrees Centigrade, introducing a gas with silicon and hydrogen atoms, providing an electrical discharge in the chamber by electric energy to ionize the gas, followed by depositing amorphous silicon on an electrophotographic substrate at a rate of 0.5 to 100 Angstronms per second by utilizing an electric discharge thereby resulting in an amorphous silicon photoconductive layer of a predetermined thickness. Although the amorphous silicon device described in this patent is photosensitive, after a minimum number of imaging cycles, less than about 1,000 for example, unacceptable low quality images of poor resolution with many deletions may result. With further cycling, that is subsequent to 1,000 imaging cycles and after 10,000 imaging cycles, the image quality may continue to deteriorate often until images are partially deleted.

Further, there is disclosed in the prior art amorphous silicon photoreceptor imaging members containing, for example, stoichiometric silicon nitride overcoatings; however, these members in some instances generate prints of low resolution as a result of the band bending phenomena. Additionally, with the aforementioned silicon nitride overcoatings, the resolution loss can in many instances be extreme thereby preventing, for example, and image formation whatsoever.

There are also illustrated in copending applications photoconductive imaging members comprised of amorphous silicon. Accordingly, for example, there is illustrated in copending application U.S. Ser. No. 695,990, entitled Electrophotographic Devices Containing Compensated Amorphous Silicon Compositions, the disclosure of which is totally incorporated herein by reference, an imaging member comprised of a supporting substrate and an amorphous hydrogenated silicon composition containing from about 25 parts per million by weight to about 1 percent by weight of boron compensated with substantially equal amounts of phosphorus. Furthermore, described in copending application U.S. Ser. No. 548,117, entitled Electrophotographic Devices Containing Overcoated Amorphous Silicon Compositions, the disclosure of which is totally incorporated herein by reference, are imaging members comprised of a supporting substrate, an amorphous silicon layer, a trapping layer comprised of doped amorphous silicon, and a top overcoating layer of stoichiometric silicon nitrides. More specifically, there is disclosed in this copending application an imaging member comprised of a supporting substrate, a carrier transport layer comprised of uncompensated or undoped amorphous silicon; or amorphous silicon slightly doped with p or n-type dopants such as boron or phosphorus, a thin trapping layer comprised of amorphous silicon which is heavily doped with p or n-type dopants such as boron or phosphorus; and a top overcoating layer of specific stoichiometric silicon nitride, silicon carbide, or amorphous carbon. However, one disadvantage with this imaging member is that the trapping layer introduces a dark decay component which reduces the charge acceptance for the imaging member.

Additionally, described in copending application U.S. Ser. No. 662,328, entitlled Heterogeneous Electrophotographic Imaging Members of Amorphous Silicon, the disclosure of which is totally incorporated herein by reference, are imaging members comprised of hydrogenated amorphous silicon photogenerating compositions, and a charge transporting layer of plasma deposited silicon oxide containing at least 50 atomic percent of oxygen. The imaging member of the present invention is comprised of similar components as illustrated in the aforementioned application with the primary exceptions that there is selected for the imaging member of the present invention a photogenerating layer containing a number of thin alternating p, n components.

Other representative prior art disclosing amorphous silicon imaging members, including those with overcoatings, are U.S. Pat. Nos. 4,460,669; 4,465,750; 4,394,426; 4,394,425; 4,409,308; 4,414,319; 4,443,529; 4,452,874; 4,452,875; 4,483,911; 4,359,512; 4,403,026; 4,416,962; 4,423,133; 4,460,670; 4,461,820; 4,484,809; and 4,490,453. Additionally, patents that may be of background interest with respect to amorphous silicon photoreceptor members include, for example, U.S. Pat. Nos. 4,359,512; 4,377,628; 4,420,546; 4,471,042; 4,477,549; 4,486,521; and 4,490,454.

Further, additional representative prior art patents that disclose amorphous silicon imaging members include, for example, U.S. Pat. No. 4,357,179 directed to methods for preparing imaging members containing high density amorphous silicon or germenium; U.S. Pat. No. 4,237,501 which discloses a method for preparing hydrogenated amorphous silicon wherein ammonia is introduced into a reaction chamber U.S. Pat. Nos. 4,359,514; 4,404,076; 4,403,026 4,397,933; 4,423,133; 4,461,819, 4,237,151; 4,356,246; 4,361,638 4,365,013; 3,160,521; 3,160,522; 3,496,037; 4,394,426; and 3,892,650. Of specific interest are the amorphous silicon photoreceptors illustrated in U.S. Pat. Nos. 4,394,425; 4,394,426 and 4,409,308 wherein overcoatings such as silicon nitride and silicon carbide are selected. Examples of silicon nitride overcoatings include those with a nitrogen content of from about 43 to about 60 atomic percent.

Additionally, precesses for depositing large area defect free films of amorphous silicon by the glow discharge of silane gases are described in Chittick et al., the Journal of the Electrochemical Society, Volume 116, Page 77, (1969). Further, the fabrication and optimization of substrate temperatures during amorphous silicon fabrication is illustrated by Walter Spear, the Fifth International Conference on Amorphous and Liquid Semiconductors presented at Garmisch Partenkirchen, West Germany in 1973. Other silicon fabrication processes are described in the Journal of Noncrystalline Solids, Volumes 8 to 10, Page 727, (1972), and the Journal of Noncrystalline Solids, Volume 13, Page 55, (1973).

Although the above described amorphous silicon photoresponsive members, paraticularly those disclosed in the copending applications, are suitable in most instances for their intended purposes there continues to be a need for improved members comprised of amorphous silicon. Additionally, there is a need for amorphous silicon imaging members that posses desirable high charge acceptance values, low charge loss characteristics in the dark, and photosensitivity extending to the red and infrared regions of the spectrum. Furthermore, there continues to be a need for improved amorphous silicon imaging members with specific charge transport layers, and certain thin multilayers of photogenerating components. Also, there is a need for hydrogenated amorphous silicon imaging members with transport layers of plasma deposited silicon oxides, silicon nitrides, silicon carbides, boron nitrides, amorphous carbon, and organosilanes. Further, ther is a need for imaging members with the aforementioned charge transport layers, and alternating multilayers exceeding 10, for example, of hydrogenated or halogenated amorphous silicon; hydrogenated, or halogenated amorphous germanium; or alloys thereof with dopants therein. Furthermore, there is a need for amorphous silicon imaging members with low surface potential decay rated in the dark, and photosensitivity in the visible nad the near infrared wavelength range. There is also a need for amorphous silicon alloy imaging members with thin layers, less than 0.5 micron for example, of 10 to about 100, of a p-type hydrogenated amorphous silicon-germanium alloy, and n-type hydrogenated amorphous silicon-germanium alloy thereby enabling members with infrared sensitivity, and low dark decay characteristics. Moreover, there is a need for the aforementioned imaging members that possess low drak decay characteristics, acceptable charging abilities without increases in dark decay, and wherein images of superior resolution can be generated.

SUMMARY OF THE INVENTION

It is therefore an object of the present invention to provide layered amorphous silicon photoresponsive imaging members.

In another object of the present invention there are provided photoresponsive imagingmembers comprised of hydrogenated or halogenated amorphous silicon alloy, and charge transport components, which members possess high charge acceptance values and low dark decay characteristics.

Also, in a further object of the present invention there are provided photoresponsive imaging members comprised of thin alternating photogenerating components of p and n hydrogenated amorphous silicon alloys, and charge transport layers.

Further, in another object of the present invention there are provided photoresponsive imaging members comprised of thin alternating photogenerating components of p and n halogenated, or hydrogenated amorphous silicon, and charge transport layers.

In yet another object of the present invention there are provided layered photoresponsive imaging members comprised of photogenerating components containing thin alternating layers of p-type hydrogenated amorphous silicon alloy, and n-type hydrogenated amorphous silicon alloys; and in contact therewith a charge transport layer comprised of hydrogenated amorphous silicon, plasma deposited silicon oxides, silicon nitrides, silicon carbides, boron nitrides, amorphous carbon, or organosilanes.

Further, in still yet another object of the present invention there are provided layered photoresponsive imaging members comprised of photogenerating components containing thin, in excess of 10, alternating layers of p-type hydrogenated amorphous silicon alloys, and n-type hydrogenated amorphous silicon alloys; and in contact therewith a charge transport layer comprised of hydrogenated amorphous silicon, plasma deposited silicon oxides, silicon nitrides, silicon carbides, boron nitrides, amorphous carbon, or organosilanes.

Additionally, in still yet another object of the present invention there are provided layered photoresponsive imaging members comprised of photogenerating components containing thin, in excess of 10, alternating layers of p-type hydrogenated amorphous silicon alloys, and n-type hydrogenated amorphous silicon alloys; and in contact therewith a charge transport layer comprised of hydrogenated amorphous silicon with from about 10 to about 50 atomic percent of hydrogen, plasma deposited silicon oxides, silicon nitrides, silicon carbides, boron nitrides, amorphous carbon, or organosilanes.

In still yet another object of the present invention there are provided layered photoresponsive imaging members comprised of photogenerating components containing thin, alternating layers of n-type germanium, and p-type hydrogenated amorphous germanium; and in contact therewith a charge transport layer comprised of hydrogenated amorphous silicon plasma deposited silicon oxide, silicon nitrides, silicon carbides, boron nitrides, amorphous carbon, or organosilanes.

Similarly, in another object of the present invention there are provided hydrogenated amorphous silicon imaging members with low dark decay characteristics, excellent charging abilities without an excessive increase in dark decay, and wherein images of superior resolution can be generated, which members contain as photogenerating components thin, less than 1 micron, alternating p, n layers.

Moreover, in another object of the present invention there are provided layered photoresponsive imaging members comprised of plasma deposited silicon oxide charge transport layers, which members are rendered photosensitive in the near infrared by suitable alloying of the alternating p, n hydrogenated amorphous silicon photogenerators with hydrogenated amorphous germanium and tin, or compositions derivable from carbon and geranium.

Another object of the present invention resides in the provision of flexible layered hydrogenated amorphous silicon imaging members containing therein charge transport molecules, and alternating thin p, n photogenerating layers.

Furthermore, in another object of the present invention there are provided imaging and printing methods accomplished with the layered hydrogenated amorphous silicon imaging members illustrated herein.

In another object of the present invention there are provided imaging members possessing photosensitivity extending to the red, and infrared regions of the spectrum, which members also simultaneously have desirable low dark decay characteristics.

These and other objects of the present invention are accomplished by the provision of a multilayered amorphous silicon photoresponsive imaging member. More specifically, in accordance with the present invention there are provided layered photoresponsive imaging members comprised of a number of alternating p, n thin photogenerating layers ofhydrogenated or halogenated amorphous silicon, hydrogenated or halogenated amorphous geranium, alloys of hydrogenated, or halogenataed amorphous silicon, and hydrogenated, or halogenated amorphous germanium, or hydrogenated amorphous silicon, and in contact therewith a suitable charge transport layer. In one specific embodiment of the present invention there is provided a photoresponsive imaging member comprised of a supporting substrate; a charge transport layer comprised of components selected from the group consisting of hydrogenated amorphous silicon with from about 10 to about 40 atomic percent of hydrogen, plasma deposited silicon oxides, silicon nitrides, silicon carbides, boron nitrides, amorphous carbon, and organosilanes; and a photogenerating component containing from about 10 to about 100 alternating layers of hydrogenated or halogenated amorphous silcicon alloys, especially alloys of hydrogenated amorphous silicon, and hydrogenated amorphous germanium, doped with p and n components, respectively. Furthermore, the present invention is directed to infrared photoresponsive imaging members comprised of a supporting substrate; a charge transport layer comprised of components selected from the group consisting of hydrogenated amorphous silicon with from about 10 to about 40 atomic percent of hydrogen, plasma deposited silicon oxides, silicon nitrides, silicon carbides, boron nitrides, amorphous carbon, and organsilanes; and a photogenerating component containing from about 10 to about 100 alternating layers of hydrogenated amotphous germanium, about 10 to about 40 atomic percent of hydrogen, doped with p and n components, respectively. Furthermore, the photoresponsive imaging members of the present invention can contain a top protective overcoating layer. Also, the charge transport layer can be situated between the p, n photogenerating layer, and the supporting substrate; or alternatively is in contact with the photogenerating layer which is situated between the supporting substrate, and the charge transport layer.

The photoresponsive or photoconductive members of the present invention can be incorporated into various imaging apparatuses wherein, for example, latent electrostatic images are formed followed by development, subsequently transferring the developed image to a suitable substrate; and optionally permanently affixing the image thereto. Moreover, the photoconductive imaging members of the present invention, in certain configurations, can be selected for use in xerographic printing processes, that is for example, when the member includes therein a component which is sensitive to the infrared region of the spectrum. Also, the photoresponsive imaging members of the present invention can be incorporated into imaging apparatus wherein there is selected for rendering the images visible a liquid development process. The photoresponsive imaging members of the present invention, when incorporated into xerographic imaging processes, possess high charge acceptances of, for example, 10 volts per micron or greater; have very low dark decay characteristics, less than 100 volts per second; and can be fabricated with the desirable properties in thicknesses of 100 microns or less. Furthermore, the photoconductive members of the present invention enable the generation of images with high resolution for an extended number of imaging cycles exceeding in most instances 500,000 imaging cycles. Additionally, the use of the imaging members of the present invention enable the generation of images with substantially no white spots. Moreover, the imaging members of the present invention are sensitive to infrared wavelengths; possess low dark decay characteristics; and are free of enviornmental hazards in that the imaging members possess no toxicological properties as is the situation, for example, with several photoconductive organic prior art photogenerating pigments, such as complexes of polyvinyl carbazole, and trinitrofluorenone, wherein the trinitrofluorenone component is considered toxic.

Specifically therefore, the photoresponsive members of the present invention can be incorporated into xerographic printing and imaging apparatuses, inclusive of those with solid state lasers or electroluminescent light sources as these members can be rendered sufficiently sensitive to wavelengths of up to 8,000 Angstroms when, for example, the photogenerating layer is suitably alloyed with germanium or tin; or fabricated from germanium-carbon alloys. Also, the photoresponsive imaging members of the present invention, when in use, are substantially insensitive to humidity conditions, and corona ions generated from corona charging devices enabling these members to generate acceptable images of high resolution for an extended number of imaging cycles.

BRIEF DESCRIPTION OF THE DRAWINGS

For a better understanding of the present invention and further features thereof reference is made to the following description of the preferred embodiments wherein.

Figure 1:
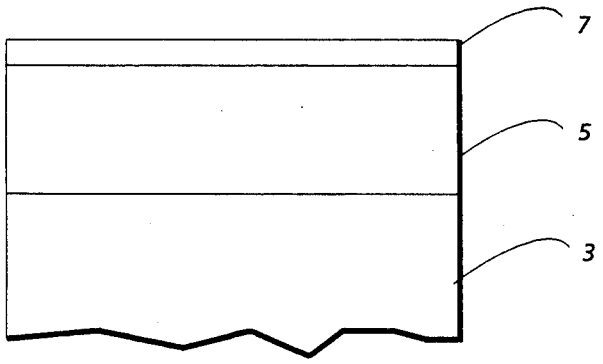
FIG. 1 is a partially schematic cross-sectional view of the photoresponsive imaging member of the present invention.

Illustrated in FIG. 1 is a photoresponsive imaging member of the present invention comprised of a supporting substrate 3; a transport layer 5 in a thickness of from about 5 to about 50 microns, and comprised of a component selected from the group consisting of hydrogenated amorphous silicon, plasma deposited silicon oxides, reference copending application U.S. Ser. No. 662,328, the disclosure of which is totally incorporated herein by reference, silicon nitrides, and silicon carbides; and from about 10 to about 100 alternating thin, in a thickness of from about 0.5 to about 2 microns, photogenerating layers 7 comprised of, for example, hydrogenated or haloenated amorphous silicon, and hydrogenated or halogenated amorphous germanium alloys of p and n-type, respectively.

Figure 2:
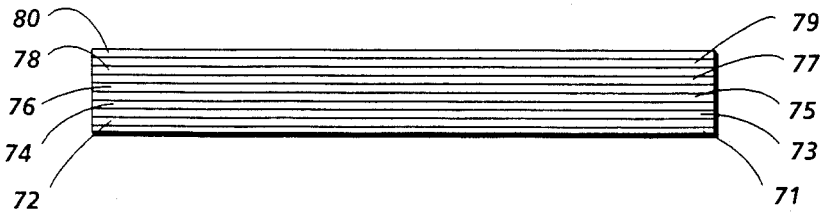
FIG. 2 is a partially schematic cross-sectional view of the p, n photogenerating layer for the photoconductive imaging members of the present invention.

Illustrated in FIG. 2 is an expanded view of the photogenerating layer, reference layer 7 of FIG. 1 of the photoresponsive imaging member of the present invention, which layer is comprised of 5 alternating layers of a p-type, hydrogenated, from about 10 to about 40 atomic percent of hdyrogen, amorphous silicon-germanium alloys, 71, 73, 75, 77, and 79; and 5 alternating layers of an n-type hydrogenated amorphous silicon-germanium alloy, 72, 74, 76, 78, and 80, in contact with a charge transport layer as defined with respect to FIG. 1, reference layer 5. The total thickness of the photogeneration layer is from about 0.5 to about 2 microns, thus enabling, for example, sufficient light absorption; accordingly, the thickness of each p-type, or n-type layer is from about 500 to about 2,00 Angstroms. In one preferred embodiment of the present inventions, the total number of thin p, n photogenerating layers is from about 10 to about 100, however, more or less layers can be selected provided the objectives of the present invention are achievable. Also, in another embodiment of the present invention the photogenerators of FIG. 2 can be deposited on a supporting substrate, such as aluminium, to enable a photoconductive imaging member.

The p, n alternating thin layers selected for the photogenerating component of the present invention contain therein dopants to render them p or n-type layer. Examples of p dopant include those components from Group III of the Periodic Table in amounts of, for example, from about 10 to 1,000 parts per million. Specific examples of Group III dopants include boron, aluminum, indinium, and the like. To obtain an n dopant layer there are selected components from Group V of the Periodic Table in amounts of, for example, from about zero (0) to 100 parts per million, these components including phosphorus, arsenic, and the like. It is important with respect to the photoresponsive imaging members of the present invention that p, n junctions be formulated; accordingly, there must be present alternating thin layers of p, n pairs, and/or n pairs as illustrated herein. Moreover, the alternating layers can be comprised of different composition, for example, the p layer may be comprised of a hydrogenated amorphous silicon germanium alloy with different amounts of silicon and germanium, while the n layer is comprised of a hydrogenated amorphous silicon geermanium alloy with less or greater amounts of silicon, and germanium as is present in the p layer. Also, for example, the n-type thin layer may be comprised ofhydrogenated amorphous germanium with no dopants therein. Also, more specifically, the photogenerating layer may be comprised of alternating layers of p, n multihunctions, whreein the n layer is doped with Group V components in an amount of from zero to 100 parts per million.

Generally, the photogenerating alternating layers, including those containing alloys can be represented by the formula p-$Si_xGe_{1-x}$/n-$Si_yGe_{1-y}$, wherein x and y are fraction numbers of from 0 to 1, p represents a p-doped layer, and n represents an n-doped layer as illustrated herein. When the aforementioned fractions, x and y are less than 1, for example, when there is an excess amount of germanium incorporated into the alloys, the photosensitivity thereof extends to he infrared region of the spectrum, that is a wavelength of from about 7,000 to about 9,000 Angstroms, without an increase in dark decay characteristics. Also, with further regard to the imaging members of the present invention, with the n-type layers, the electron concentration is very high, for example, from about $10^{14}$ to about $10^2$ per cubic centimeter, and the hole concentration is substantially low; in contrast with the p-type layers, the electron concentration is low, and the hole concentration is high. Although it is not desired to be limited by theory, it is believed that the primary purpose of the alternating photogenerating layer is to neutralize the high carrier density with the low carrier density of the neighboring layer by the transfer of mobile carriers, referred to in the art as space charge doping. such doping also permits a reduction in the potential of the barrier height at the interface between the p-type, and the n-type layers thereby permitting photogenerated carriers to transport across the multilayer structure, reference layer 7, into the transport layer, reference layer 5, without much difficulty. This contrasts with the prior art wherein a lowering of the carrier concentration in the photogeneration layer is accomplished by the introduction of dopants of the opposite polarity in compensated materials. This results in an increase in the localized state density which decreases the carrier range, and the choice of compensating dopant is restricted.

Moreover, the imaging members of the present invention can be prepared by various methods, including the plasma deposition of the multilayer photogenerator on the transport layer, which layer has been prepared as described in the copending applications and patents referred to herein, the disclosures of which are totally incorporated herein by reference. With the aforementioned member, the first deposited layer of the photognerator is a p-type material, and the last layer is an n-type enabling the surface to be positively charged; for negative charging the aforementioned order of the p, and n-type layers is reversed. Thus, more specifically, when it is desired to apply positive charges to the photoconductive imaging member of the present invention, the thin p, n photogenerating layer components contain as the bottom layer a p-doped component, and as the top layer an n-doped component. In contrast, when negatively charged imaging members are desired, the thin photogenerating layers include as the first component an n-doped species, and as the top component in teh entire layer a p-doped species.

Futher, in another embodiment of the present invention the method of preparation comprises the deposition of the photogenerator multilayers on a supporting substrate, followed by the deposition of the charge transport layer. Preferably, in the aforementioned member the first component of the multilayer is n-type, and the last layer is p-type, which order can be reversed when the charge transport is replaced by an electron transport layer.

More specifically, with regard to the generator multilayer, it can be prepared by simultaneously introducing into a reaction chamber a silane gas often in combination with other gases, inclusive of alloying gases, and doping gases. The total flow rate of the gases is maintained at between about 50 to about 400 sccm, and the gas mixture pressure is maintained at a constant 250 to 1,000 milliTorr. Also, the radio frequency electrical power density is between about 0.01 and about 1 watts/cm$^2$ of electrode area; and the substrate temperature during deposition can be from about 100 to about 300 degrees Centigrade, reference U.S. Pat. Nos. 4,466,380, and 4,544,167, the disclosured of each of these patents being totally incorporated herein by reference. Subsequent to the deposition of the first multilayer in the desired thickness, the gas inputs are ceased, and the reaction chamber is evacuated for about 10 minutes to permit the removal of theunused gases. The gas mixture for the composition of the second layer is introduced into the chamber, and the deposition of the second layer is initiated. When the aforementioned layer attains the desired thickness, the gas influx is terminated, and the reaction chamber is evacuated. The aforementioed process steps are accomplished repeatedly until the desired number of layers is obtained in the appropriate thickness.

The imaging members of the present invention can be used in either a positive or negative charging mode. With a negative charging mode, that is wherein the trasnporting layer permits the movement of holes therethrough, the photogenerating multilayer is situated between the charge transport layer and the supporting substrate. With a positive charging mode, the charge transport layer is situated between the photogenerating multilayer, and the supporting substrate.

Inclusion of other elements, such as germanium or tin, in the hydrogenated amorphous silicon photogenerating p,n layer of hte present invention can be accomplished by the simultaneous glow discharge of, for example, silane and germane or stanane. The alloying of silicon with germanium and/or tin is useful as the band gap of the alloy is smaller than that of the hydrogenated amorphous silicon itself thus permitting photoresponse to longer wavelengths.

The supporting substrates for each of hte imaging members illustrated in the Figures may be opaque or substantially transparent, thus this substrate can be comprised of numerous substances providing the objectives of the present invention are achieved. Specific examples of substrates ar a layer of an organic or inorganic material having a semiconductive surface layer thereon, such as indium tin oxide; or a conductive material such as, for example, aluminum, chromium, nickel, brass, stainless steel, and the like. The substrate may be flexible or rigid and can have many different configurations such as, for example, a plate, a cylindrical drum, a scroll, an endless flexible belt, and the like. Preferably, the substrate is in the form of a cylindrical drum, or endless flexible belt. In some situations, it may be desirable to coat on the back of the substrate, particularly when the substrate is an organic polymeric material, an articurl layer such as, for example, polycarbonate materials commercially available as makrolon. The substrates are preferably comprised of aluminum, stainless steel sleeve, or an oxidized nickel composition.

Also, the thickness of the substrate layer depends on many factors including economical considerations, and required mechanical properites. Accordingly thus, this layer can be of a thickness of from about 0.01 inch (254 microns) to about 0.2 inch (5080 microns), and preferablyis of a thicnkess of from about 0.05 inch (1270 microns) to about 0.15 inch (3810 microns). In one particularly preferred embodiment, the supporting substrate is comprised of oxidized nickel in a thickness of from about 1 mil to about 10 mils.

Illustrative examples of materials selected for the photogenerating layers are hydrogenated amorphous silicon, preferably with 10 to 40 atomic percent of hydrogen, especially amorphous silicon as described in the copending applications referred to hereinbefore. With further respet to each of the alternating thin photogenerating layers, in accordance with the present invention every other layer contais therein a p dopant, such as boron, and the other alternating layers include therein an n dopant such as phosphorus. This alternating system is important to the present invention it that, for example, it enables space charge doping which reduces the concentration of dark carriers.

Another important layer with respect to the imaging member of the present invention is the charge transport layer containing therein, for example, hydrognated amorphous silicon, plasma deposited silicon oxides, silicon nitride, or silicon carbide, as well as the other molecules illlustrated hereinbefore. These components can be prepared by the glow discharge of theappropriate mixture of gases in accordance with the parameter sand process as illustrated in the copending applications referred to herein.

Illustrative examples of charge transport components are as indicated hereinbefore, and include, for example, plasma deposited silicon oxides, silicon nitrides, hydrogenated amorphous silicon, and other similar components providing, for example, they enable the transport of charge to the photogenerator p, n multilayer structure.

Imaging membres of the present invention can be prepared in accordance with the processes as described in the copending applications referred to hereinbefore. More specifically, thus the imaging members of the present invention can be prepared by simultaneously introducing into a reaction chamber a silane gas often in combination with other gases for the purpose of doping or alloying. In one specific embodiment, the process of preparation involves providing a receptacle containing therein a first substrate electrode means, and a second counterelectrode means providing a cylindrical surface on the first electrode means, heating the cylindrical surface with heating elements contained in the first electrode means while causing the first electrode means to axially rotate, introducing into the reaction vessel a source of silicon containing gas often in combination with other dilluting, doping or alloying gases at a right angle with respect to the cylindrical member, applying an rf voltage on the second electrode with the first electrode grounded whereby the silane gas is decomposed resulting in the deposition of hydrogenated amorphous silicon or doped hydrogenated amorphous silicon on the cylindrical member. Also, the total flow rates of the gases are maintained between 50 adn 400 sccm, and the gas mixture pressure is held at a constant 250 to 1,000 milliTorr. Also, the radio frequency electrical power density rf is between 0.01 and 1 watts/cm$^2$ of electrode area, and the substrate temperature during the deposition process can be between 100 and 300 degrees Centigrade.

Specifically therefore, the amorphous silicon photoconducting layer can be deposited by the glow discharge decomposition of a silane gas along, or decomposition in the presence of small amounts of dopant gases such as diborane and/or phosphine. The range of useful flow rates, radio frequency power levels, and reactor pressures are approximately the same as that described in the copending applications referred to herein.

This invention will now be described in detail with respect to specific preferred embodiments thereof, it being understood that these examples are intended to be illustrative only. The invention is not intended to be limited to the materials, conditions or process parameters recited herein. All parts and percentages are by weight unless otherwise indicated.

EXAMPLE I

There was prepared a photogenerating layer p, n multijunction component consisting of 20 alternating layers of n-type, and p-type hydrogenated amorphous silicon by the glow discharge plasma deposition at 230 degrees Centigrade, of silane gases and phosphine, and borane gases as dopants. The thickness of each p, and each n layer was 500 Angstroms, and the total thickness of the 20 alternating layers was 1 micron. More specifically, there was deposited on an aluminum of a thickness of 1 millimeter, that is 1,000 microns, 20 alternating layers, the first layer being comprised of hydrogenated amorphous silicon with about 25 atomic percent of hydrogen containing therein 100 parts per million of boron, followed by the deposition of a n-type layer consisting of hydrogenated amorphous silicon with about 25 atomic percent of hydrogen containing therein as a dopant 9 parts per million of phosphorus. The 20th, or last thin alternating layer was the n-type species enabling an imaging member that can be positively charged. Each of the p-type species layers, which contain about 100 parts per million of boron; and each of the n-type layers which contain 9 parts per million of phosphorus, results ia perodic 0.4 electron volt shift of the Fermi level around the midgap. While it is known that the aforementioned doping levels yields materials of high dark conductivity, about $10^{-7}$ (ohm-cm)$^{-1}$ for isolated layers, and a dark decay in excess of 100 volts per second, as determined wiht an electrometer, this materkal will not charge with a corotron, and does not retain any charge. In contrast, the aforementioned prepared p, n junction photogenerating layer could be positively charged to 40 volts, and possessed a dark decay rate of less than 10 volts per second, these measurements being accomplished with an electrometer. Upon exposure to light, the prepared p, n junction multiphotogenerating layer, which is also functioning as a charge transport layer, was discharged completely, indicating there were no barriers for the transport of photogenerated carriers at the interface.

EXAMPLE II

A photoresponsive imaging member was prepared by depositing the 20 alternating multilayer p, n photogenerating layers of Example I, on a charge transport layer with a thickness of 4.5 microns, and comprised of hydrogenated amorphous silicon with 25 atomic percent of hydrogen, and 5 parts per million of boron. Subsequently, this imaging member was charged positively to 55 volts, and had a dark decay of only 40 volts per second. Upon exposure to light, the aforementioned imaging member discharged completely indicating that there was no barrier to the injection of photogenerated carriers from teh multilayers to the transport layer.

EXAMPLE III

An infrared photoresponsive imaging member can be prepared by repeating the procedure of Examples I and II, with the exception that there is selected as the photogenerating layer 20 alternating layers of a p-type hydrogenated amorphous silicon hydrogenated amorphous germanium alloy, each with 20 atomic percent of hydrogen, and containing 100 percent of silicon for the p layer, and 100 percent of germanium for the n layer; and further wherein the germanium contains no dopants therein, and the hydrogenated amorphous silicon is doped with 100 parts per million of boron. The alternating layers can each be of a thickness of 500 Angstroms. This member can also be charged positively, and will have an acceptable dark decay. Further, it is believed that the high dark electronic conductivity of the hydrogenated amorphous germanium is neutralized by space charging doping with a high concentration of holes, in the p-type hydrogenated amorphous silicon, while simultaneously maintaining the infrared absorbing optical propertied of the hydrogenated amorphous germanium.

The dark decay and the light induced decay potentials, reference the appropriate aforementioned Examples were measured by a series of electrical probes mounted along the circumference of the photoreceptor.

This is accomplished by testing the imaging member in a standard scanner for the purpose of determining the photoconductive characteristics thereof. The scanner is comprised of an apparatus in which there is provision for mounting and rotating the imaging member along its axis. Also, a charging corotrom exposure wire, erase lamps, and voltage measuring probes are mounted along the circumference of the scanner. This testing was affected by permitting the scanner to operate at a surface speed of 20 revolutions per minute, and subjecting the imaging member to a positive, or negative polarity of 7,000 volts corona potential with a 10 centimeter long corotrom. The scanner results indicate the charging capabilities of the imaging member, that is, dark decay values; and the discharge characteristics when subjected to light illumination.

The data generated indicated that images can be formulated, developed, and transferred with the aforementioned imaging members, especially the members of Example II, and III, which images would be of excellent resolution with no background deposits.

Other photoconductive imaging members can be prepared in accordance with the above procedures wherein, however, there are selected as the photogenerating multilayered structure alternating thin layers of hydrogenated amorphous silicon; alternating layers of hydrogenated amorphous germanium; or alternating layers of hydrogenated amorphous silicon, hydrogenated amorphous germanium alloys, with the alloy composition being as indicated hereinbefore.

Although the invention has been described with reference to specific preferred embodiments, it is not intended to be limited thereto. Rather, those of ordinary skill in the art will recognize that variations and modifications, including equivalents thereof, may be made which are included within the spirit of the present invention and within the scope of the following claims.

What is claimed is:

1. An imaging member comprised of a supporting substrate, a p, n multijunction photogenerating layer comprised of from about 8 to about 100 alternating layers of components selected from the group consisting of hydrogenated amorphous silicon, hydrogenated amorphous germanium, alloys of hydrogenated amorphous silicon and hydrogenated amorphous germanium; and a charge transporting layer.

2. An imaging member in accordance with claim 1 wherein there is present from about 10 to about 30 alternating layers.

3. An imaging member in accordance with claim 1 wherein the alloy is of the formula p-doped-$Si_xGe_{1-x}$/n-doped-$Si_yGe_{1-y}$ wherein x, and y are number fractions of from zero to 1.

4. An imaging member in accordance with claim 1 wherein the photogenerating multilayered structure is of a thickness of from about 0.5 to about 2 microns.

5. An imaging member in accordance with claim 1 wherein the charge transporting layer is selected from the group consisting of hydrogenated amorphous silicon, plasma deposited silicon oxides, silicon nitrides, silicon carbides, boron nitrides, amorphous carbon, and organosilanes.

6. An imaging member in accordance with claim 1 wherein hydrogen is present in an amount of from about 10 to about 40 atomic percent.

7. An electrostatographic imaging member comprised of p, n, alternating components of at least 10 thin layers of a doped hydrogenated or halogenated amorphous silicon alloy photogenerating layer, and in contact therewith a charge transporting layer.

8. An electrostatographic imaging member comprised of p, n, alternating components of at least 10 thin layers of hydrogenated or halogenated amorphous silicon alloy photogenerating layer with dopants therein, and in contact therewith a charge transporting layer, with components therein selected from the group consisting of hydrogenated amorphous silicon, plasma deposited silicon oxides, silicon nitrides, silicon carbides, boron nitrides, amorphous carbon, and organosilanes.

9. An imaging member in accordance with claim 8 wherein the dopants are selected from the group consisting of p and n components.

10. An imaging member in accordance with claim 9 wherein the p dopant is boron.

11. An imaging member in accordance with claim 9 wherein the n dopant is phosphorus.

12. An imaging member in accordance with claim 10 wherein the p dopant is present in an amount of from about 10 to about 100 parts per million.

13. An imaging member in accordance with claim 11 wherein the n phosphorus dopant is present in an amount of from about 1 to about 10 parts per million.

14. An imaging member in accordance with claim 8 wherein the photogenerating layer is comprised of an amorphous silicon germanium alloy.

15. An imaging member in accordance with claim 8 wherein the photogenerating layer is comprised of an aamorphous silicon tin alloy.

16. An imaging member in accordance with claim 8 wherein the photogenerating layer is comprised of hydrogenated carbon germanium.

17. An imaging member in accordance with claim 1 further including therein a supporting substrate.

18. An imaging member in accordance with claim 8 wherein the total photogenerating layer thickness is from about 0.5 to about 2 microns.

19. An imaging member in accordance with claim 8 wherein the charge transport is of a thickness of from about 5 to about 50 microns.

20. A method of imaging which comprises providing the photoresponsive imaging member of claim 1, subjecting this member to imagwise exposure, developing the resulting image with a toner composition, and subsequently transferring the image to a suitable substrate, and optionally permanently affixing the image thereto.

21. A method of imaging in accordance with claim 20 wherein the dopants are selected from the group consisting of p and n dopants.

22. A method of imaging in accordance with claim 21 wherein the p dopant is boron.

23. A method of imaging in accordance with claim 21 wherein the n dopant is phosphorus.

24. A method of imaging member in accordance with claim 22 wherein the p boron dopant is present in an amount of from about 10 to about 100 parts per million.

25. A method of imaging in accordance with claim 23 wherein the n phosphorus dopant is present in an amount of from about 10 to about 100 parts per million.

26. A method of imaging in accordance with claim 20 wherein there is present from about 10 to about 30 alternating layers.

27. A method of imaging in accordance with claim 20 wherein the alloy is of the formula p-doped-$Si_xGe_{1-x}$/n-doped-$Si_yGe_{1-y}$ wherein s, and y are number fractions of from zero to 1.

28. A method of imaging in accordance with claim 20 wherein for the multilayers there are selected halogenated components.

29. A method of imaging in accordance with claim 20 wherein the charge transporting layer is selected from the group consisting of hydrogenated amorphous silicon, plasma, deposited silicon oxides, silicon nitrides, silicon carbides, boron nitrides, amorphous carbon, and organosilanes.

30. A method of imaging in accordance with claim 20 wherein hydrogen is present in an amount of from about 10 to abaout 40 atomic percent.

31. A method of imaging in accordance with claim 20 wherein the electrostatographic imaging member is comprised of alternating components of at least 10 thin layers of a hydrogenated or halogenated amorphous silicon alloy photogenerating layer with dopants therein; and in contact therewith a charge transporting layer with components therein selected from group consisting of hydrogenated amorphous silicon, plasma deposited silicon oxides, silicon nitrides, silicon carbides, boron nitrides, amorphous carbon, and organosilanes.

32. An imaging member in accordance with claim 1 wherein for the multilayers there are selected halogenated components.

33. An imaging member comprised of a supporting substrate, and from about 8 to about 100 of p, n multijunction photogenerating layer with a p photogenerating layer in contact with the supporting substrate, and an n photogenerating layer in contact with the p photogenerating layer, said p and said n photogenerating layer components being selected from the group consisting of hydrogenated or halogenated amorphous silicon, hydrogenated or halogenated amorphous germanium, alloys of hydrogenated or halogenated amorphous silicon, and alloys of hydrogenated or halogenated amorphous germanium; and a charge transporting layer.

34. An imaging member in accordance with claim 33 wherein there is selected as the p photogenerating component, an alloy of the formula p-doped-$Si_xGe_{1-x}$/n-doped-$Si_yGe_{1-y}$ wherein x and y are number fractions of from zero to 1.

35. An imaging member in accordance with claim 1 wherein the n photogenerating layer component is an alloy of the formula p-doped-$Si_xGe_{1-x}$/n-doped-$Si_yGe_{1-y}$wherein x and y are number fractions of from zero to 1.

36. An imaging member in accordance with claim 33 wherein the charge transporting layer is selected from the group consisting of hydrogenated amorphous silicon, plasma deposited silicon oxides, silicon nitrides, silicon carbides, boron nitrides, amorphous carbon, and organosilanes.

37. An imaging member in accordance with claim 33 wherein hydrogen is present in an amount of from about 10 to about 40 atomic percent.

38. An imaging member in accordance with claim 33 wherein the charge transporting layer is in contact with the support substrate.

39. An imaging member in accordance with claim 33 wherein the charge transporting layer is in contact with the photogenerating layer.

40. An imaging member in accordance with claim 33 wherein there are present from about 10 to about 30 p photogenerating layers, and from about 10 to about 30 n photogenerating layers wherein each n layer in situated between two p layers.

41. An imaging member in accordance with claim 1 wherein there are present from about 10 to about 30 p photogenerating layers, and from about 10 to about 30 n photogenerating layers wherein each n layer is situated between two p layers.

42. An imaging member in accordance with claim 7 wherein there are present from about 10 to about 30 p photogenerating layers, and from about 10 to about 30 n photogenerating layers wherein each n layer is situated between two p layers.

43. An imaging member in accordance with claim 8 wherein there are present from about 10 to about 30 p photogenerating layers, and from about 10 to about 30 n photogenerating layers wherein each n layer is situated between two p layers.

* * * * *